US007165280B2

(12) United States Patent
Wang

(10) Patent No.: US 7,165,280 B2
(45) Date of Patent: Jan. 23, 2007

(54) FLUID-CONTROL MEDICAL MATTRESS

(76) Inventor: Chao-Jan Wang, 7F-5, No. 36, Wuling Rd., Hsinchu (TW)

( * ) Notice: Subject to any disclaimer, the term of this patent is extended or adjusted under 35 U.S.C. 154(b) by 125 days.

(21) Appl. No.: 10/927,387

(22) Filed: Aug. 26, 2004

(65) Prior Publication Data

US 2006/0042015 A1 Mar. 2, 2006

(51) Int. Cl.
*A47C 27/10* (2006.01)
*A61G 7/047* (2006.01)
*A47K 3/06* (2006.01)

(52) U.S. Cl. ..... 5/713; 5/606; 5/928; 5/933; 4/585; 4/588

(58) Field of Classification Search ..... 5/713, 5/710, 706, 654, 655.3, 606, 928, 933; 4/538, 4/547, 585, 588, 621
See application file for complete search history.

(56) References Cited

U.S. PATENT DOCUMENTS

| | | | | | |
|---|---|---|---|---|---|
| 573,625 | A * | 12/1896 | Ruffner | 4/588 |
| 736,089 | A * | 8/1903 | Gray | 4/585 |
| 1,738,411 | A * | 12/1929 | Welch | 5/655 |
| 2,471,302 | A * | 5/1949 | Boward | 4/588 |
| 2,504,646 | A * | 4/1950 | Burrow | 4/588 |
| 2,672,628 | A * | 3/1954 | Spanel | 5/655 |
| 2,974,322 | A * | 3/1961 | Norris | 4/659 |
| 3,058,122 | A * | 10/1962 | McDaniel et al. | 4/547 |
| 3,083,376 | A * | 4/1963 | Johns | 4/621 |
| 4,583,252 | A * | 4/1986 | McCourt | 4/584 |
| D293,363 | S * | 12/1987 | Everard | D23/277 |
| 4,744,112 | A * | 5/1988 | Keesling, Jr. | 4/585 |
| 4,964,183 | A * | 10/1990 | LaForce, Jr. | 5/421 |
| 5,025,515 | A * | 6/1991 | Rhines | 4/585 |
| 5,247,712 | A * | 9/1993 | Williams | 4/585 |
| 5,287,576 | A * | 2/1994 | Fraser | 5/637 |
| 5,307,529 | A * | 5/1994 | Wang | 4/585 |
| 5,345,622 | A * | 9/1994 | Plone | 4/588 |
| 5,613,252 | A * | 3/1997 | Yu et al. | 5/88.1 |
| 6,543,068 | B1 * | 4/2003 | Penninger | 4/585 |
| 2006/0042015 | A1 * | 3/2006 | Wang | 5/713 |

FOREIGN PATENT DOCUMENTS

WO WO 8702235 A1 * 4/1987

* cited by examiner

*Primary Examiner*—Robert G. Santos
(74) *Attorney, Agent, or Firm*—Alan D. Kamrath; Nikolai & Mersereau, P.A.

(57) ABSTRACT

A fluid-control medical mattress includes a platform and multiple supports mounted on the platform. Each support is a bladder for selectively receiving fluid to support a patient. A skirt is mounted to a periphery of the platform and surrounds the platform for retaining water with the platform for a nurse to conveniently clean the body of the patient who lies on the platform. The multiple supports respectively correspond to the head, neck, shoulder, pelvis and knee for supporting the patient who lies on the platform when the multiple supports are full of fluid.

19 Claims, 10 Drawing Sheets

FLUID-CONTROL MEDICAL MATTRESS

BACKGROUND OF THE INVENTION

1. Field of the Invention

The present invention relates to a medical mattress, and more particularly to a fluid-control medical mattress.

2. Description of Related Art

A conventional medical mattress in accordance with the prior art comprises multiple parallel longitudinal gasbags arranged in a rectangular structure. The pressure of a conventional medical mattress can not be partially adjusted relative to a specific portion of the patient to change the posture of the patient.

When using the conventional medical mattress for a patient who needs long-term medical care, a nurse is necessary to execute various actions of care to the patient. However, the conventional medical mattress may propagate germs or cause a peculiar smell when being continually used. The conventional medical mattress is not helpful for a nurse to execute various actions of care to the patient.

The present invention has arisen to mitigate and/or obviate the disadvantages of the conventional medical mattress.

SUMMARY OF THE INVENTION

The main objective of the present invention is to provide an improved medical mattress that is fluid-controlled and can support the patient for a nurse to conveniently clean the patient's body.

To achieve the objective, the fluid-control medical mattress in accordance with the present invention comprises a platform and multiple supports mounted on the platform. Each support is a bladder for selectively receiving fluid to support a patient. A skirt is mounted to a periphery of the platform and surrounds the platform for retaining water with the platform for a nurse to conveniently clean the body of the patient who lies on the platform. The multiple supports respectively correspond to the head, neck, shoulder, pelvis and knee for supporting the patient who lies on the platform when the multiple supports are full of fluid.

Further benefits and advantages of the present invention will become apparent after a careful reading of the detailed description with appropriate reference to the accompanying drawings.

DETAILED DESCRIPTION OF THE INVENTION

Figure 1:
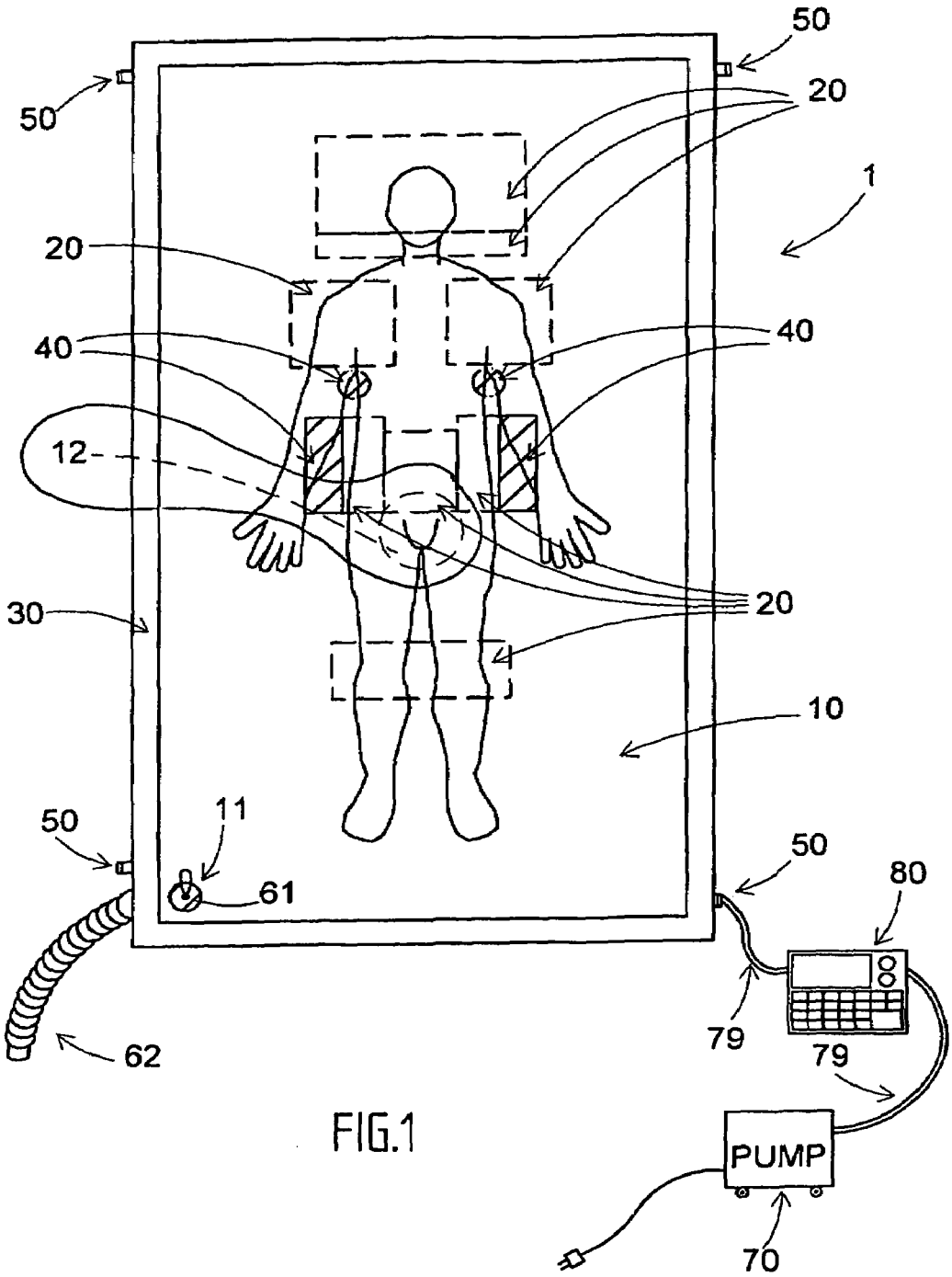
FIG. 1 is a top plan view of a fluid-control medical mattress in accordance with the present invention.

Referring to the drawings and initially to FIG. 1, a fluid-control medical mattress (1) in accordance with the present invention comprises a platform (10) for a patient to lie thereon. Multiple supports (20) are mounted on the platform (10) for supporting the patient, one for the patient's head, one for the patient's neck, two for the patient's shoulders, two for the patient's pelvis, one for the patient's buttocks and one for the patient's knees. A skirt (30) upwardly extends from a periphery of the platform (10) for containing water with the platform (10). Multiple stoppers (40) are situated on the patient's axillas and two sides of the pelvis when the patient lies thereon.

In the preferred embodiment of the present invention, the platform (10) is a thin bladder for selectively containing fluid.

Each support (20) is a bladder for containing fluid and has a size corresponding to the positions of the patient. Some of the supports (20), for the patient's head, neck and knees, respectively, have a concave defined in a top thereof for anti-slip. Some of the supports (20), for the patient's shoulders and pelvis, have multiple cubic or cylindrical protrusions upwardly extending from a top thereof for promoting friction. The support (20) for the patient's buttocks can lift the patient's buttocks for a nurse to easily clean the patient's anus.

The skirt (30) is a loop in the form of a bladder for containing fluid and surrounding the platform (10). The skirt (30) forms an endless wall after containing fluid for retaining water such that the nurse can conveniently clean the patient's body.

Each stopper (40) is a bladder for containing fluid and prevents the patient from lateral movement when the multiple stoppers (40) contain fluid and expand.

Figure 9:
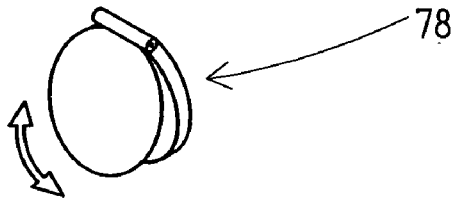
FIG. 9 is a perspective view of the valve of the fluid-control medical mattress in accordance with the present invention.

The platform (10), the multiple supports (20) and the multiple stoppers (40) can communicate with one another via multiple paths. Multiple valves (78), as shown in FIG. 9, are mounted among the platform (10), the multiple supports (20) and the multiple stoppers (40) for selectively separating the platform (10), the multiple supports (20) and the multiple stoppers (40) from one another.

With reference to FIG. 1, the platform (10) includes multiple joints (50) mounted to an outer periphery thereof and communicating with inner peripheries of the platform (10), the multiple supports (20) and the multiple stoppers (40) for guiding fluid into the platform (10), the multiple supports (20) and the multiple stoppers (40). A first outlet (11) is defined in a bottom of the platform (10), and a first block (61) is securely received in the first outlet (11) for selectively opening the first outlet (11). An exhaust tube (62) is mounted to the platform (10) and communicates with the first outlet (11) in the platform (10). A recess (12) is defined in the bottom of the platform (10) corresponding to the buttocks of the patient who lies on the platform (10). The recess (12) retains water for a nurse to conveniently clean the patient's anus. A second outlet (13) is defined in a bottom of the recess (12) for exhausting the dirty water, and a second block (63) is selectively securely received in the second outlet (13) for closing the second outlet (13).

The fluid-control medical mattress (1) is operated with a pump (70) for pumping the fluid into the platform (10), the multiple supports (20) and the multiple stoppers (40) via a tube (79) that is connected to the pump (70) and a corresponding one of the multiple joints (50). The pump (70) is a hydraulic pump or a pneumatic pump. A control device (80) is electrically connected to the pump (70) for operating the pump (70) for controlling the pressure in the platform (10), the multiple supports (20) and the multiple stoppers (40).

Figure 2:
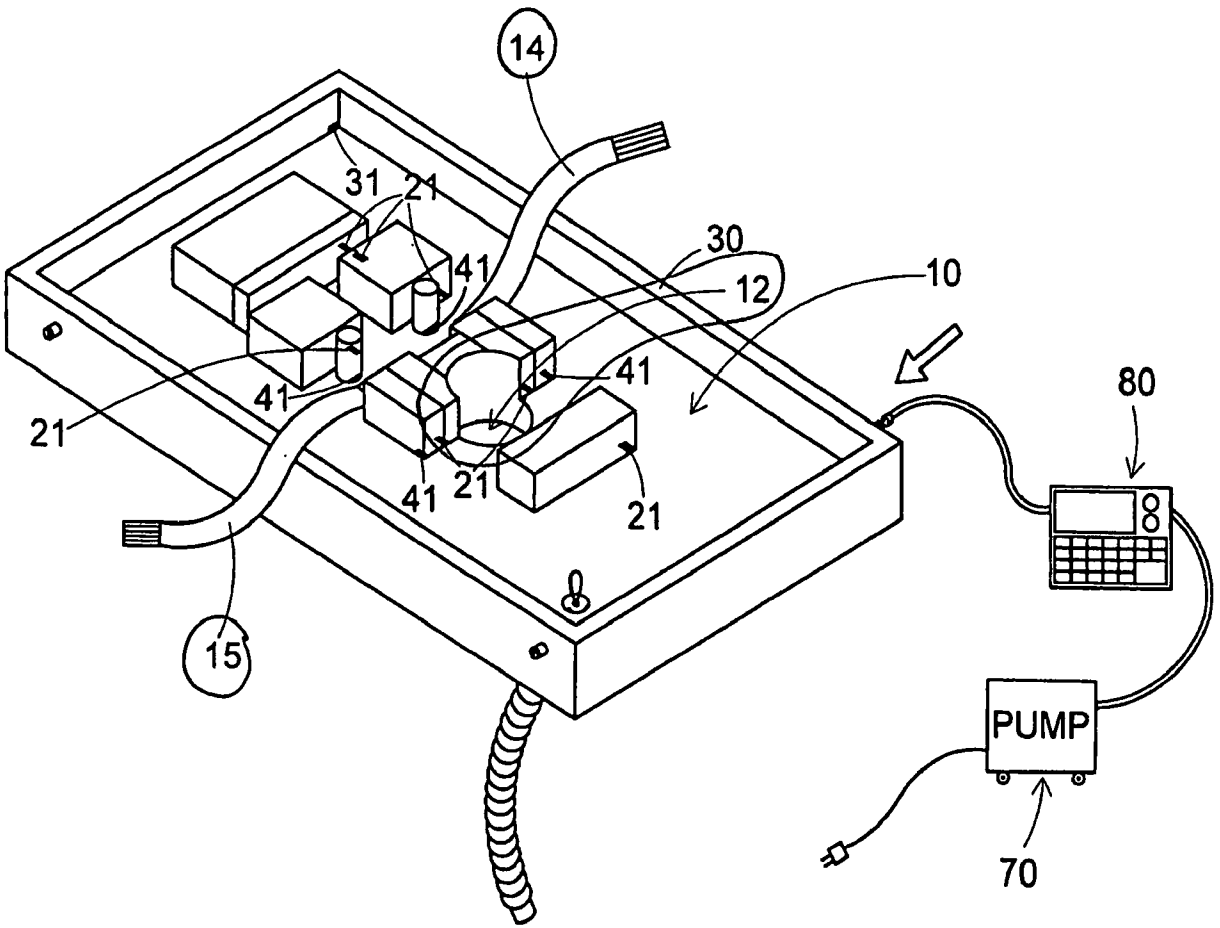
FIG. 2 is a perspective view of the fluid-control medical mattress in accordance with the present invention.
Figure 3:
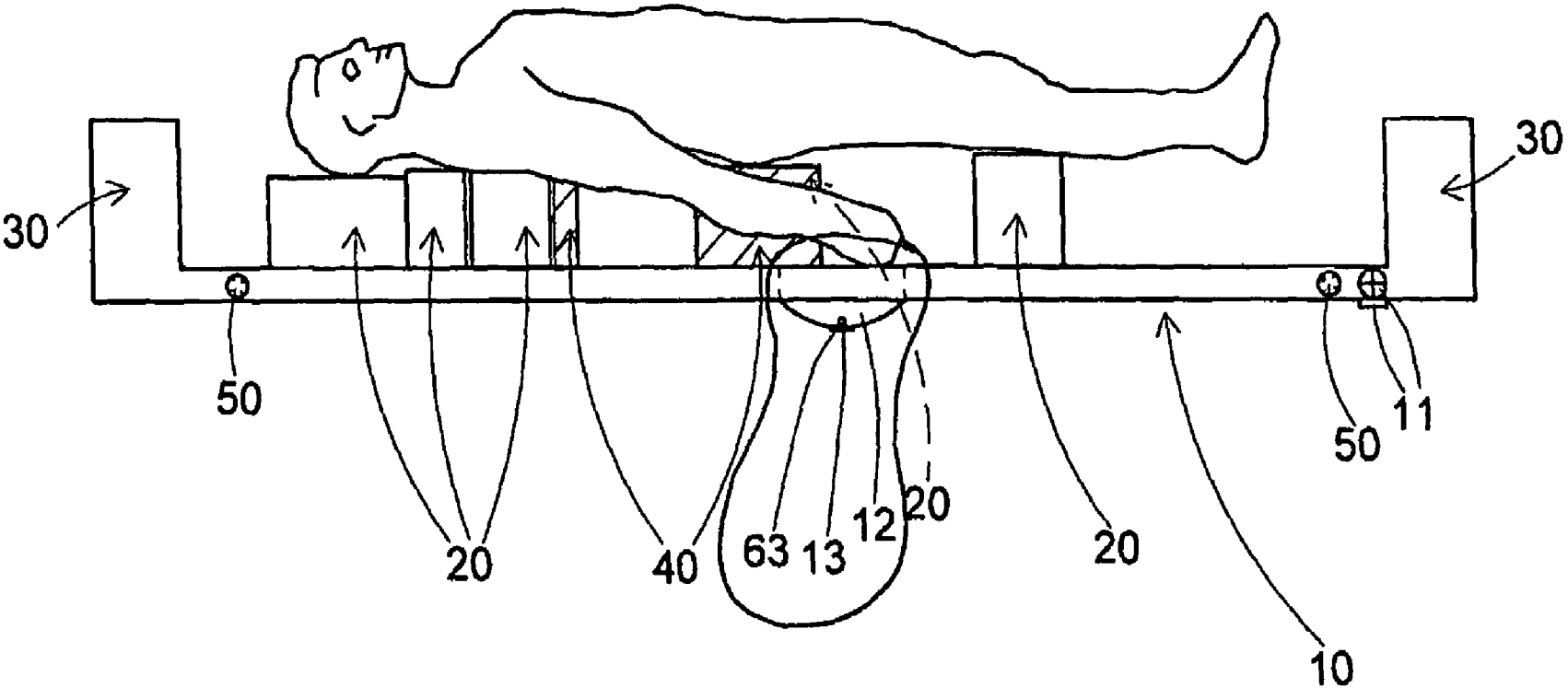
FIG. 3 is a side plan view of the fluid-control medical mattress in FIG. 2.

With reference to FIG. 2, the platform (10) includes a first belt (14) and a second belt (15) each having a first end secured on the platform (10) and a second end selectively connected to each other to further position the patient on the platform (10).

Each support (20), stopper (40) and skirt (30) has a sensor (21, 41, 31) secured thereon and electrically connected to the control device (80) for sensing the pressure in each of the supports (20), the stoppers (40) and the skirt (30), respectively, to start/stop the pump (70).

The platform (10) and the skirt (30) can retain water when the platform (10), the multiple supports (20), the skirt (30) and the multiple stoppers (40) are full of fluid.

Figure 4A:
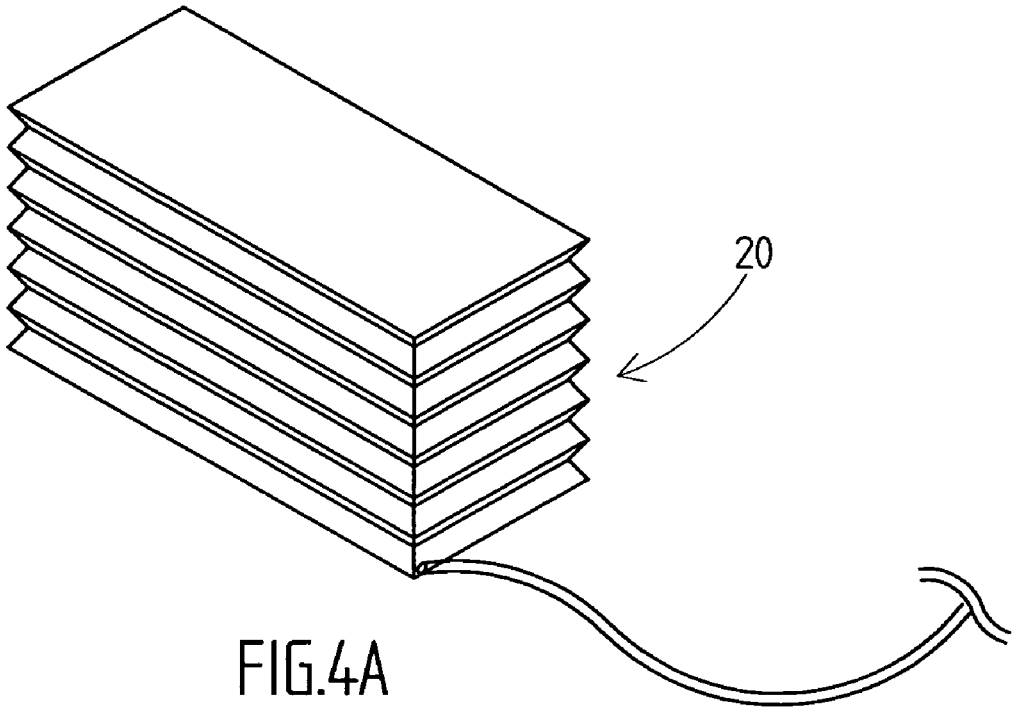
FIG. 4A is a perspective view of the support of the present invention when being full of fluid.
Figure 4B:
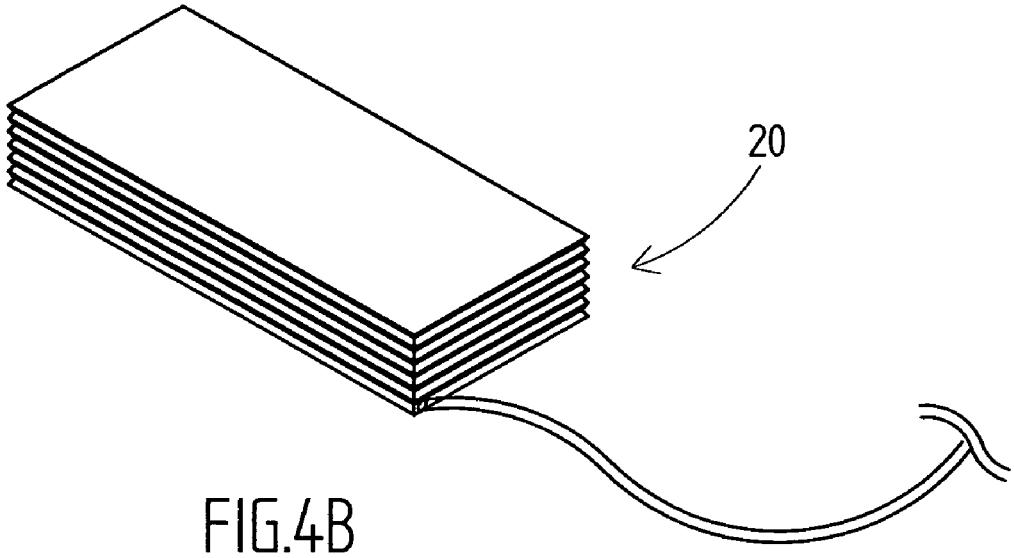
FIG. 4B is a perspective view of the support of the present invention when the fluid in the support is drained.

With reference to FIGS. 4A and 4B, each support (20) has a series of crepe structures that expand to support the patient's body when full of fluid and that pile on another when the fluid in each of the support (20) is exhausted.

Figure 5:
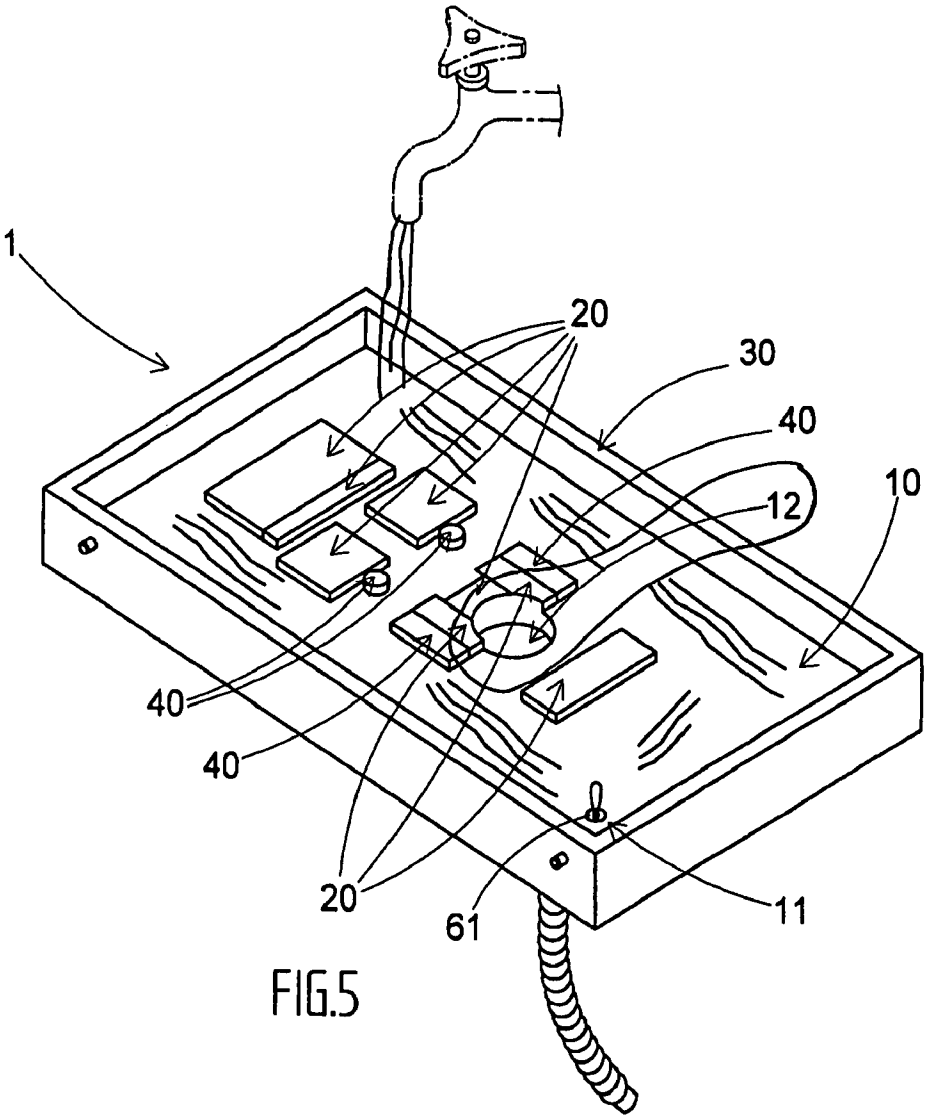
FIG. 5 is a perspective view of the fluid-control medical mattress of the present invention when retaining water.

With reference to FIG. 5, the first outlet (11) and the second outlet (13) are respectively blocked by the first block (61) and the second block (63), and the skirt (30) is full of fluid to form an endless wall for retaining water. Furthermore, the fluid in each support (20) and the stopper (40) is exhausted such that the patient lies on the platform (10). Then, the nurse can clean the patient by using the water retained within the skirt (30) and can pull the first block (61) for draining the dirty water after cleaning the patient's body and using the water in the recess (12) to clean the patient's anus. Finally, the second block (63) is pulled to draining the water in the recess (12).

Figure 6:
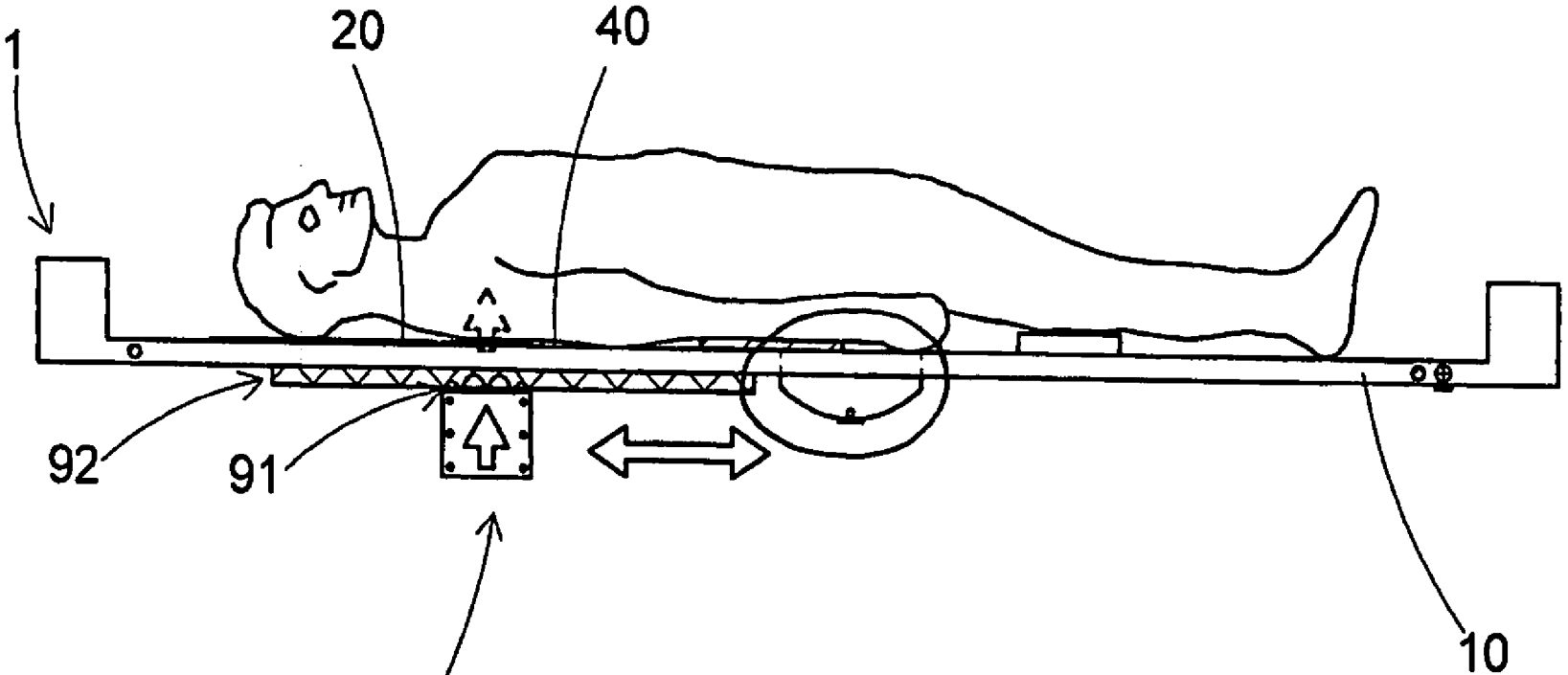
FIG. 6 is a second side plan view of the fluid-control medical mattress when the massage device in mounted.
Figure 7:
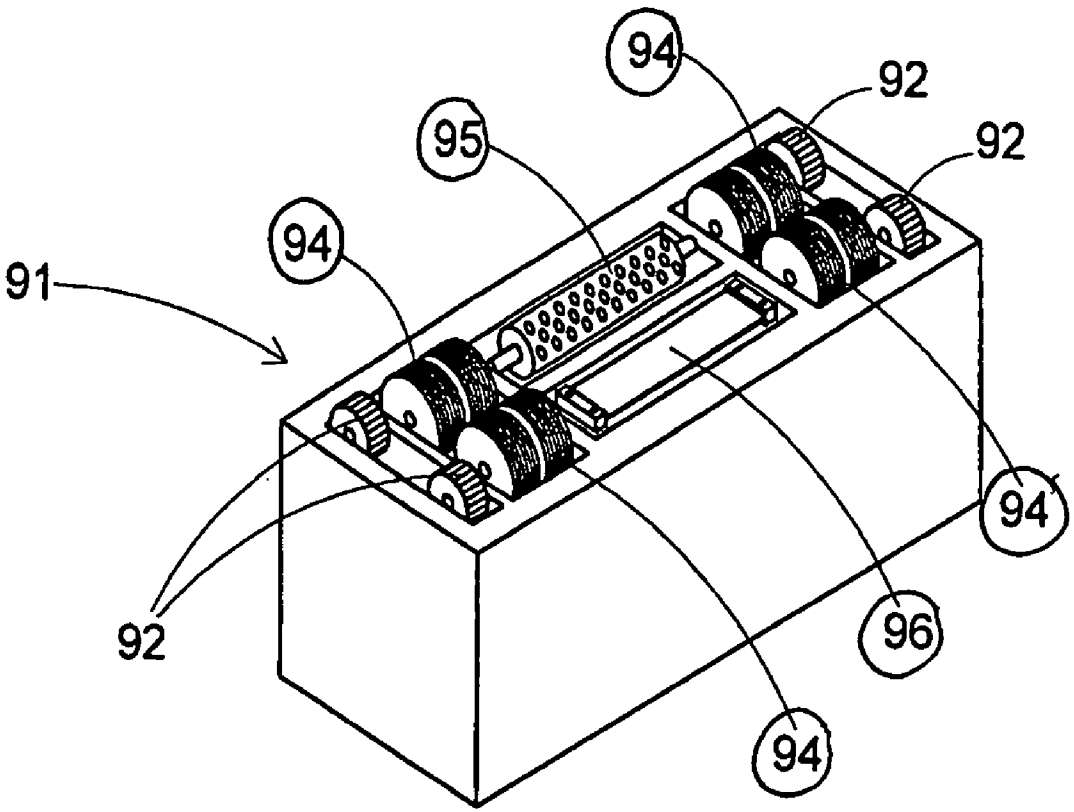
FIG. 7 is a perspective view of the massage device in FIG. 6.

With reference to FIGS. 6 and 7, the fluid-control medical mattress (1) in accordance with the present invention further comprises a massage device (90) mounted to a lower side of the platform (10). The massage device (90) includes a drive device (not shown) mounted therein and an actuated device (91) partially extending out of the massage device (90). The actuated device (91) includes multiple teethed wheels (92) each engaged to a rail (93) that is mounted on the lower side of the platform (10) such that the massage device (90) is reciprocally moved relative to the platform (10). The massage device (90) includes multiple massage rollers (94) and a flexible clapper (96) with a cylinder (95) with a series of bosses (not numbered) partially extending out of the massage device (90) for massaging the patient's back when the massage device (90) is reciprocally moved relative to the platform (10) and the fluid in the platform (10), the supports (20) and the stoppers (40) is exhausted.

Figure 8A:
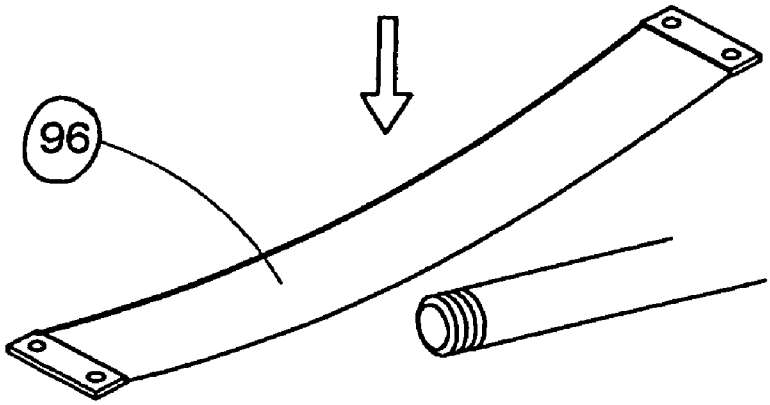
FIG. 8A is a first operational view of the clapper of the massage device in FIG. 7.
Figure 8B:
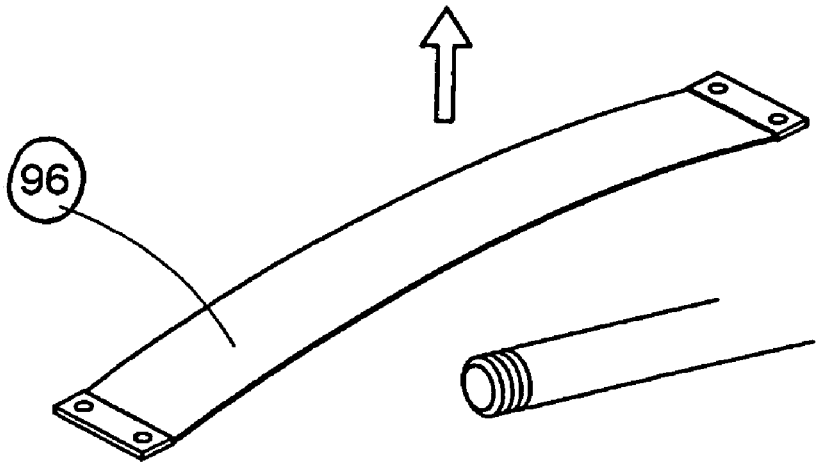
FIG. 8B is a second operational view of the clapper of the massage device in FIG. 7.

With reference to FIGS. 7, 8A and 8B, the massage device (90) further includes a flexible clapper (96) mounted on a top of the massage device (90) and corresponding to the lungs of the patient when lying on the platform (10). The flexible clapper (96) is actuated by an electromagnet or a cam set and reciprocally smoothly slaps the back of the patient for reducing phlegm.

Figure 10:
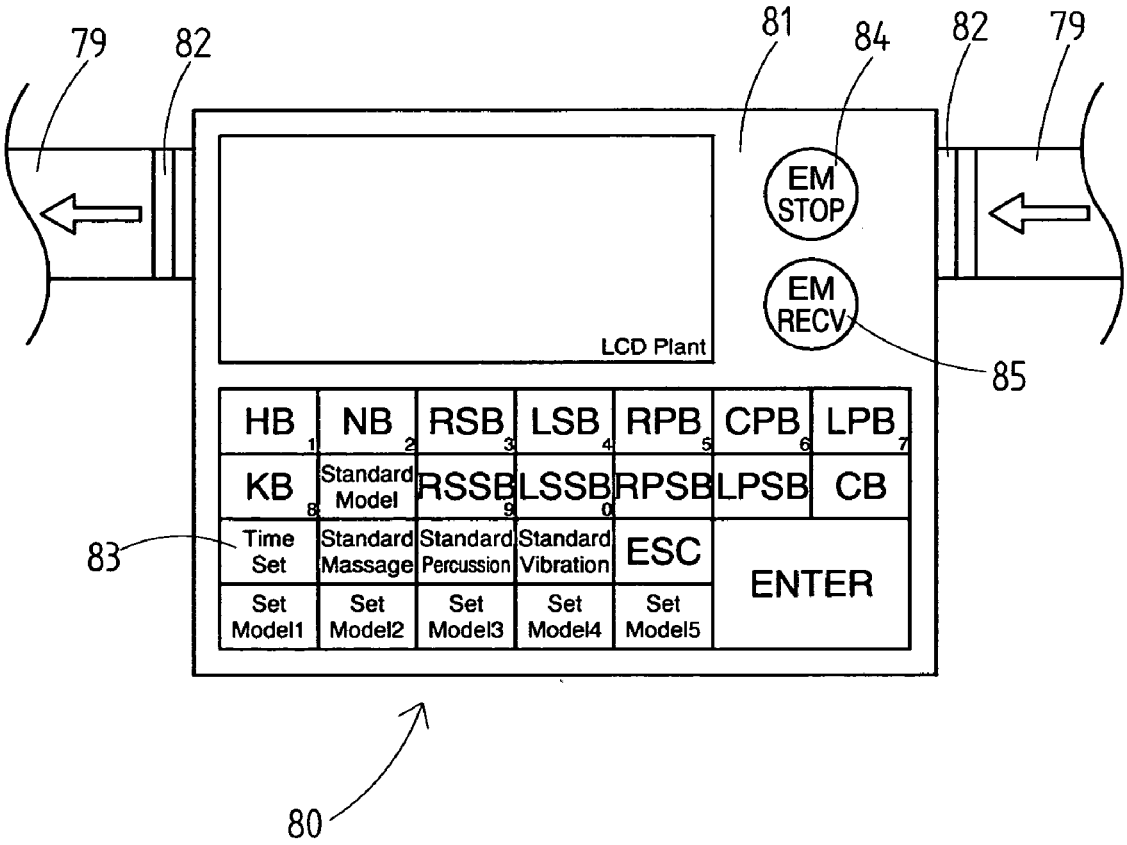
FIG. 10 is a top plan view of the control device of the fluid-control medical mattress in accordance with the present invention.
Figure 11:
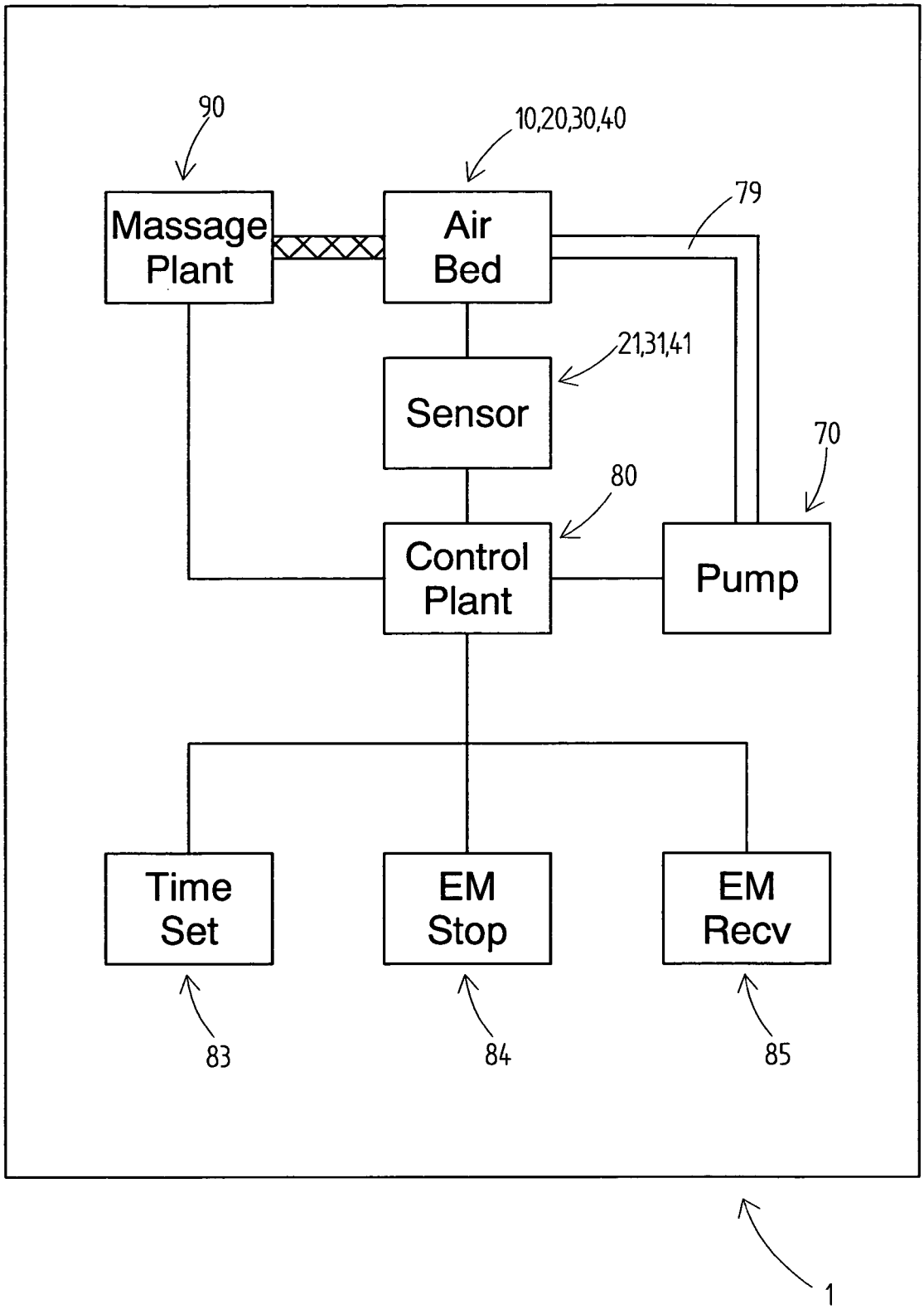
FIG. 11 is an electric connect diagram of the fluid-control medical mattress in accordance with the present invention.

With reference to FIGS. 10 and 11, the control device (80) is electrically connected to the pump (70) and the massage device (90), and includes a control unit mounted therein and including a control panel (81) and an electric circuit. Two control valves (82) are mounted to two opposite sides of control device (80) and, respectively, communicating with the tube (79) to selectively close the tube (79) for controlling the pressure in the platform (10), the supports (20), the skirt (30) and the stoppers (40). The valves (78) and the control valve (82) are check valves. The control device (80) includes a time calculator (83) for controlling the operating time of the drive device of the massage device (90), the valves (78) and the control valves (82). The control device (80) includes an emergency button (84) mounted on the panel (81). The pump (70) and the massage device (90) are immediately stopped when the emergency button (84) is pressed. The control device (80) includes an emergency recovery button (85) mounted on the panel (81). The pump (70) and the massage device (90) are immediately stopped, and the fluid in the platform (10), the supports (20), the skirt (30) and the stoppers (40) is exhausted in seconds for a doctor to take first aid to the patient when the emergency recovery button (85) is pressed.

Although the invention has been explained in relation to its preferred embodiment, it is to be understood that many other possible modifications and variations can be made without departing from the spirit and scope of the invention as hereinafter claimed.

What is claimed is:

1. A fluid-control medical mattress for a patient, the medical mattress comprising:

a platform;

multiple supports mounted on the platform, each support being a bladder for selectively receiving fluid and adapted to support the patient;

a skirt mounted to a periphery of the platform and surrounding the platform;

wherein the multiple supports respectively correspond to the head, neck, shoulder, pelvis and knee for supporting the patient who lies on the platform when the multiple supports are full of fluid, the skirt retains water with the platform for a nurse to conveniently clean the body of the patient who lies on the platform, and the skirt is a bladder and forms an endless wall for retaining water when being full of fluid;

multiple stoppers each being a bladder for containing fluid, the multiple stoppers situated on the patient's axillas and two sides of the pelvis when the patient lies on the platform; and multiple valves mounted in paths communicating the platform, the multiple supports, the skirt and the stoppers and to selectively separate the platform, the multiple supports, the skirt and the stoppers from one another.

2. The medical mattress as claimed in claim 1, wherein the platform comprises two belts each having a first end secured on the platform and a second end selectively connected to each other for positioning the patient who lies on the platform.

3. The medical mattress as claimed in claim 1, wherein the platform comprises a first outlet defined in the platform for draining the water after cleaning and a first block selectively securely received in the first outlet for retaining water within the skirt.

4. The medical mattress as claimed in claim 1, wherein the platform comprises a recess defined therein and corresponding to buttocks of the patient who lies on the platform, the recess retaining water for the nurse to conveniently clean the patient's anus.

5. The medical mattress as claimed in claim 1, wherein each valve is a check valve.

6. The medical mattress as claimed in claim 1, wherein the platform comprises multiple joints mounted to the periphery thereof and communicating with the paths among the platform, the multiple supports, the skirt and the stoppers.

7. The medical mattress as claimed in claim 6 further comprising a tube connected to a corresponding one of the multiple joints for transmitting fluid into the platform, the multiple supports, the skirt and the stoppers.

8. The medical mattress as claimed in claim 7 further comprising a pump communicating with the tube for pumping the fluid into the platform, the multiple supports, the skirt and the stoppers.

9. The medical mattress as claimed in claim 8 further comprising a control device electrically connected to the pump and the valves for controlling the pressure in the platform, the multiple supports, the skirt and the stoppers.

10. The medical mattress as claimed in claim 9, wherein the control device comprises a time calculator mounted therein for controlling operating time of the pump and the valves.

11. The medical mattress as claimed in claim 9, wherein each support, each stopper and the skirt respectively have a sensor secured thereon and respectively electrically connected to the control device for sensing the pressure in each of the multiple supports, the multiple stoppers and the skirt to start/stop the pump.

12. The medical mattress as claimed in claim 9, further comprising a massage device mounted on the platform, wherein the control device comprises an emergency button mounted on a panel thereof, thereby, the pump and the massage device are immediately stopped when the emergency button is pressed.

13. The medical mattress as claimed in claim 10, wherein the control device comprises an emergency recovery button mounted on the panel thereof, thereby, the pump is immediately stopped, and the fluid in the platform, the supports, the skirt and the stoppers is exhausted in seconds for a doctor to take first aid to the patient when the emergency recovery button is pressed.

14. A fluid-control medical mattress comprising:

a platform;

multiple supports mounted on the platform, each support being a bladder for selectively receiving fluid and adapted to support the patient;

a skirt mounted to a periphery of the platform and surrounding the platform; and a massage device mounted to a lower side of the platform, wherein the massage device includes a drive device mounted therein and an actuated device partially extending out of the massage device;

wherein the multiple supports respectively correspond to the head, neck, shoulder, pelvis and knee for supporting the patient who lies on the platform when the multiple supports are full of fluid, the skirt retains water with the platform for a nurse to conveniently clean the body of the patient who lies on the platform, the massage device reciprocally is moved relative to the platform, and the drive device of the massage device drives the actuated device that contacts with a patient's back via the platform.

15. The medical mattress as claimed in claim 14, wherein the actuated device of the massage device includes multiple teethed wheels each engaged to a rail that is mounted on a lower side of the platform such that the massage device is reciprocally moved relative to the platform, and the massage device includes multiple massage rollers and a cylinder with a series of bosses partially extending out of the massage device for massaging the patient's back when the massage device is reciprocally moved relative to the platform and the fluid in the platform, the supports and the stoppers is exhausted.

16. The medical mattress as claimed in claim 14 further comprising a control device electrically connected to the massage device for controlling the massage device.

17. The medical mattress as claimed in claim 16, wherein the control device comprises a time calculator mounted therein for controlling operating time of the massage device.

18. The medical mattress as claimed in claim 16, wherein the control device comprises an emergency button mounted on a panel thereof, thereby, the massage device is immediately stopped when the emergency button is pressed.

19. The medical mattress as claimed in claim 16, wherein the control device comprises an emergency recovery button mounted on a panel thereof, thereby, the massage device is immediately stopped and the fluid in the platform, the supports, the skirt and the stoppers is exhausted in seconds for a doctor to take first aid to the patient when the emergency recovery button is pressed.

* * * * *